US010216120B2

(12) United States Patent
Borenstain et al.

(10) Patent No.: US 10,216,120 B2
(45) Date of Patent: Feb. 26, 2019

(54) LIQUID ELECTROPHOTOGRAPHIC PRINTERS

(71) Applicant: HP Indigo, B.V., Amstelveen (NL)

(72) Inventors: Shmuel Borenstain, Neve-DanieL (IL); Asaf Anufa, Rehovot (IL)

(73) Assignee: HP INDIGO B.V., Amstelveen (NL)

( * ) Notice: Subject to any disclaimer, the term of this patent is extended or adjusted under 35 U.S.C. 154(b) by 0 days.

(21) Appl. No.: 15/748,125

(22) PCT Filed: Oct. 29, 2015

(86) PCT No.: PCT/EP2015/075180

§ 371 (c)(1),
(2) Date: Jan. 26, 2018

(87) PCT Pub. No.: WO2017/071767

PCT Pub. Date: May 4, 2017

(65) Prior Publication Data

US 2018/0224775 A1 Aug. 9, 2018

(51) Int. Cl.

| | |
|---|---|
| ***G03G 15/11*** | (2006.01) |
| ***G03G 15/16*** | (2006.01) |
| ***G03G 21/00*** | (2006.01) |

(52) U.S. Cl.

CPC ..... *G03G 15/1605* (2013.01); *G03G 15/11* (2013.01); *G03G 21/0088* (2013.01)

(58) Field of Classification Search

CPC .. G03G 15/1605; G03G 15/11; G03G 15/169; G03G 21/0088

USPC ..... 399/237, 249

See application file for complete search history.

(56) References Cited

U.S. PATENT DOCUMENTS

| | | | | |
|---|---|---|---|---|
| 6,115,576 | A | 9/2000 | Nakano et al. | |
| 6,219,512 | B1 | 4/2001 | Saitoh | |
| 6,459,875 | B1 | 10/2002 | Saitoh | |
| 6,873,817 | B2 | 3/2005 | Park et al. | |
| 7,400,850 | B2 | 7/2008 | Romem | |
| 7,907,873 | B2 | 3/2011 | Sandler et al. | |
| 8,685,610 | B2 | 4/2014 | Golodetz et al. | |
| 2011/0045400 | A1* | 2/2011 | Mitsuzawa ..... | G03G 9/0825 399/237 X |

(Continued)

FOREIGN PATENT DOCUMENTS

| | | |
|---|---|---|
| EP | 2249212 | 11/2010 |

OTHER PUBLICATIONS

Russell et al., Characterization of Liquid Electrophotographic Toner Particles Using Non-polar Electrical Field Flow Fractionation and MALLS, Sep. 1, 2000.

(Continued)

*Primary Examiner* — Sophia S Chen
(74) *Attorney, Agent, or Firm* — HP Inc. Patent Department

(57) ABSTRACT

In certain examples, a liquid electrophotographic printer has a compressive element. The compressive element removes a portion of carrier liquid from an inked image on an imaging element. The compressive element is selectively engageable and a controller disengages the compressive element for a first layer of liquid toner so as to retain carrier liquid in the first layer, and engages the compressive element for a subsequent layer of liquid toner so as to remove a portion of carrier liquid from the subsequent layer.

16 Claims, 4 Drawing Sheets

(56) References Cited

U.S. PATENT DOCUMENTS

| | | | | |
|---|---|---|---|---|
| 2012/0093544 | A1* | 4/2012 | Sandler | G03G 15/1605<br>399/297 |
| 2016/0179036 | A1* | 6/2016 | Deprez | G03G 15/11<br>399/249 |

OTHER PUBLICATIONS

The International Searching Authority, "The International Search Report and the Written Opinion, PCT Application No. PCT/EP2015/075180", dated Jul. 7, 2016, 14 pages.

* cited by examiner

LIQUID ELECTROPHOTOGRAPHIC PRINTERS

CLAIM FOR PRIORITY

The present application is a national stage filing under 35 U.S.C. § 371 of PCT application number PCT/EP2015/075180, having an international filing date of Oct. 29, 2015, the disclosure of which is hereby incorporated by reference in its entirety.

BACKGROUND

Liquid electrophotographic printing, also referred to as liquid electrostatic printing, uses liquid toner to form images on a print medium. A liquid electrophotographic printer may use digitally controlled lasers to create a latent image in the charged surface of an imaging element such as a photo imaging plate. In this process, a uniform static electric charge is applied to the imaging element and the lasers dissipate charge in certain areas creating the latent image in the form of an invisible electrostatic charge pattern conforming to the image to be printed. An electrically charged printing substance, in the form of liquid toner, is then applied and attracted to the partially-charged surface of the imaging element, recreating the desired image.

In certain liquid electrophotographic printers, a transfer element is used to transfer developed liquid toner to a print medium. For example, a developed image, comprising liquid toner aligned according to a latent image, may be transferred from an imaging element to a transfer blanket of a heatable transfer cylinder and from the transfer blanket to a desired substrate, which is placed into contact with the transfer blanket.

At least two different methodologies may be used to print multi-color images on a liquid electrophotographic printer. Both methodologies involve the generation of multiple separations, where each separation is a single-color partial image. When these separations are superimposed they result in the desired full color image being formed. In a first methodology, a color separation layer is generated on the imaging element, transferred to the transfer cylinder and is finally transferred to a substrate. Subsequent color separation layers are similarly formed and are successively transferred to the substrate on top of the previous layer(s). This is sometimes known as a "multi-shot color" imaging sequence. In a second methodology, a "one shot color" process is used. In these systems, the imaging element transfers a succession of separations to the transfer blanket on the transfer cylinder, building up each separation layer on the blanket. Once some number of separations are formed on the transfer blanket, they are all transferred to the substrate together.

BRIEF DESCRIPTION OF THE DRAWINGS

Various features will be apparent from the detailed description which follows, taken in conjunction with the accompanying drawings, which together illustrate, by way of example only, certain examples, and wherein.

DETAILED DESCRIPTION

Figure 1:
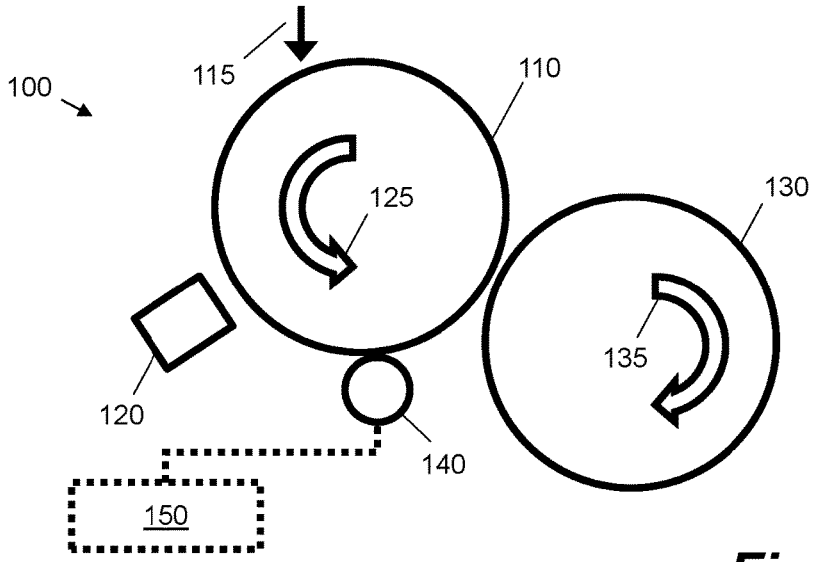
FIG. 1 is a schematic diagram showing a liquid electrophotographic printer in accordance with an example.

In the following description, for purposes of explanation, numerous specific details are set forth in order to provide a thorough understanding of the present systems and methods. It will be apparent, however, that the present apparatus, systems and methods may be practiced without these specific details. Reference in the specification to "an example" or similar language means that a particular feature, structure, or characteristic described in connection with the example is included in at least that one example, but not necessarily in other examples.

As described herein, an example liquid electrophotographic printer comprises an imaging element such as a photo imaging plate (PIP). The imaging element may be implemented as a drum or a belt. A latent image is generated on the imaging element and at least one image development unit deposits a layer of liquid toner onto the imaging element. The liquid toner comprises ink particles and a carrier liquid. The ink or pigment particles are charged and may be arranged upon the imaging element based on a charge pattern of a latent image. Once liquid toner is applied to the latent image on the imaging element, an inked image is formed on the imaging element. The inked image comprises ink particles that are aligned according to the latent image. In one case, the ink particles may be 1-2 microns in diameter. A heatable transfer element, sometimes referred to as an intermediate transfer member, receives the inked image from the imaging element and transfers the inked image to a print substrate. In an example one shot color process, the inked image is one of a plurality of separation layers and the heatable transfer element receives multiple separation layers of inked images from the imaging element. These are then built up upon the heatable transfer element prior to transferring all of the layers to the print substrate. In some examples, each of the multiple inked images are a different color.

Due at least in part to the transfer element being heatable, a portion of the carrier liquid in the toner is evaporated prior to the transfer of the inked images to the print substrate. This evaporation may also be enhanced by the use of an external heat source. The amount of carrier liquid on the transfer element prior to the transfer onto the print substrate directly affects the quality of the image printed on the substrate. Therefore adequate heating results in a ready finished image in the form of a hot, nearly dry tacky plastic film. This film may then be applied to the print substrate to complete the print operation.

When multiple layers are built up on the heatable transfer element during a one shot color process, the first separation layer may suffer from over-drying in comparison with the later layers. This is because the first layer remains on the heatable transfer element for longer than the subsequent layers, these being transferred to the transfer element at later points in time. In some scenarios, this over-heating may cause poor transferability of the ink from the transfer element to the print substrate and can cause poor adhesion of the ink to the substrate. This can limit media gamut.

In some scenarios, over-drying of lower layers, such as the first layer, can be reduced by specifically configuring the composition of the liquid toners. For example, in one case, the toner properties are adjusted to reduce the evaporation caused by a longer time being spent on the heatable transfer element. In this case, the amount of liquid carrier that is evaporated depends on the properties of the toner. For example, it may be dependent on the particular polymer used, the composition of the carrier liquid and the pigments used. Therefore different toners with different evaporation properties may be used for each separation layer.

In other scenarios, over-drying can be reduced by adjusting the drying level separately for each separation layer by controlling air supply units in a ventilation system. The drying level is adjusted for each separation as a function of the order that the separations are developed on the transfer element. For example, less air may be provided to a first separation layer compared to the final separation layer.

In the present examples, a liquid electrophotographic printer comprising a compressive element is described. Such a liquid electrophotographic printer may reduce over-drying by removing a portion of carrier liquid. The compressive element may be selectively engageable to remove a portion of carrier liquid from an inked image prior to the inked image being transferred to the heatable transfer element. Such a liquid electrophotographic printer also comprises a controller that causes the compressive element to disengage for a first layer of liquid toner so as to retain carrier liquid in the first layer. The controller can engage the compressive element for subsequent layers of liquid toner to remove a portion of carrier fluid from these subsequent layers. This means that the subsequent layers on the transfer element require less of the carrier liquid to be removed through heating and/or other evaporation means, thus reducing over-drying of the first separation layer.

In some examples, the compressive element is already disengaged for a first layer of liquid toner, such that the controller does not need to disengage the compressive element for the first layer. In a disengaged position, the compressive element may be disposed in position away from the imaging element. In some examples, the compressive element is a roller. In one example, the controller can cause the compressive element to remove a greater proportion of carrier fluid from a subsequent layer than for a previous layer. For example, a greater proportion of carrier fluid is removed from the third layer than is removed from the second layer.

FIG. 1 is a schematic diagram showing a liquid electrophotographic printer 100 in accordance with an example. Liquid electrophotography, sometimes also known as Digital Offset Color printing, is the process of printing in which liquid toner is applied onto a surface having a pattern of electrostatic charge (i.e. a latent image) to form a pattern of liquid toner corresponding with the electrostatic charge pattern (i.e. an inked image). This pattern of liquid toner is then transferred to at least one intermediate surface, and then to a print medium. During the operation of a digital liquid electrophotographic system, ink images are formed on the surface of a photo imaging plate. These ink images are transferred to a heatable blanket cylinder and then to a print medium.

According to the example of FIG. 1, a latent image is formed on an imaging element 110 by rotating a clean, bare segment of the photo imaging plate 110 under a photo charging unit (not shown). The imaging element may comprise a photo imaging plate or other image carrier. The imaging element in this example is cylindrical in shape, e.g. is constructed in the form of a drum, and rotates in a direction of arrow 125. The photo charging unit may include a charging device, such as corona wire, a charge roller, scorotron, or any other charging device. A uniform static charge may be deposited on the imaging element 110 by the photo charging unit. As the imaging element 110 continues to rotate, it passes an imaging unit 115 where one or more laser beams may dissipate localised charge in selected portions of the imaging element 110 to leave an invisible electrostatic charge pattern that corresponds to the image to be printed, i.e. a latent image. In some implementations, the photo charging unit applies a negative charge to the surface of the imaging element 110. In other implementations, the charge may be a positive charge. The imaging unit 115 may then locally discharge portions of the imaging element 110, resulting in local neutralised regions on the imaging element 110.

In the described example, ink is transferred onto the imaging element 110 by at least one image development unit 120. An image development unit may also be known as a Binary Ink Developer unit. There may be one image development unit 120 for each ink color. During printing, the appropriate image development unit 120 is engaged with the imaging element 110. The engaged image development unit 120 presents a uniform film of ink to the imaging element 110. The ink contains electrically-charged pigment particles which are attracted to the opposing charges on the image areas of the imaging element 110. The ink is repelled from the uncharged, non-image areas. The imaging element 110 now has a single color ink image on its surface, i.e. an inked image or separation. In other implementations, such as those for black and white (monochromatic) printing, one or more ink developer units may alternatively be provided.

The ink may be a liquid toner, comprising ink particles and a carrier liquid. The carrier liquid may be an imaging oil. An example liquid toner ink is HP ElectroInk™. In this case, pigment particles are incorporated into a resin that is suspended in a carrier liquid, such as Isopar™. The ink particles may be electrically charged such that they move when subjected to an electric field. Typically, the ink particles are negatively charged and are therefore repelled from the negatively charged portions of imaging element 110, and are attracted to the discharged portions of the imaging element 110. The pigment is incorporated into the resin and the compounded particles are suspended in the carrier liquid. The dimensions of the pigment particles are such that the printed image does not mask the underlying texture of the print substrate, so that the finish of the print is consistent with the finish of the print substrate, rather than masking the print substrate. This enables liquid electrophotographic printing to produce finishes closer in appearance to conventional offset lithography, in which ink is absorbed into the print substrate.

Returning to the printing process, the imaging element 110 continues to rotate and transfers the ink image to a heatable transfer element 130. The transfer element 130 may also be known as a blanket cylinder or an intermediate transfer member and it rotates in a direction of arrow 135. In use, the transfer element 130 is heated. The transfer of an inked image from the imaging element 110 to the transfer element 130 may be deemed the "first transfer". Following the transfer of the inked image onto the rotating and heated transfer element 130, the ink is heated by the transfer element 130. In certain implementations, the ink may also be heated from an external heat source which may include an air supply. This heating causes the ink particles to partially melt and blend together. At the same time most of the carrier liquid is evaporated and may be collected and reused. In one example case, ink is applied to the transfer element 130 at a concentration of 20% (with the remaining 80% comprising carrier liquid).

As previously discussed, in liquid electrophotography printers employing a one shot color process, the imaging element 110 rotates several times, transferring a succession of separations and building them up on the transfer element 130 before they are transferred to the print substrate. This transfer from the transfer element 130 to the print substrate may be deemed the "second transfer". Each separation may be a separate color inked image that can be layered on the transfer element 130. For example, there may be four layers, corresponding to the standard CMYK colors (cyan, magenta, yellow and black), that make up the final image which is transferred to the print substrate.

The print substrate may be any coated or uncoated material suitable for liquid electrophotographic printing, including paper and thin polyurethane or other type of plastic media. In certain examples, the paper comprises a web formed from cellulosic fibers, having a basis weight of from about 75 gsm to about 350 gsm, and a calliper (i.e. thickness) of from about 4 mils (thousandths of an inch-around 0.1 millimeters) to about 200 mils (around 5 millimeters). In certain examples, the paper includes a surface coating comprising starch, an acrylic acid polymer, and an organic material having an hydrophilic-lipophilic balance value of from about 2 to about 14 such as a polyglycerol ester.

The print substrate may be fed on a per sheet basis, or from a roll sometimes referred to as a web substrate. As the print substrate contacts the transfer element 130, the final image is transferred to the print substrate.

As was discussed above, in the one shot color process an image including multiple separations and/or color layers is acquired on the transfer element 130. Because the first separations are held for longer periods of time on the heated transfer element 130 as compared to the subsequent additional layers, the first separations may become over-heated and/or dried. This can lead to undesirable image back transfer from the transfer element 130 to the imaging element 110. It may also negatively affect the first and second transfer performance. Thus if special pre-treatment to the media is not implemented, media gamut is narrow. To mitigate ink dryness, special rubbery blankets were developed with the capacity to absorb large amount of imaging oil and to slow down the drying. These blankets help mitigate ink dryness. But yet, when compared with multi-shot color process, media gamut of one shot color process may be narrower.

Over-drying may be reduced by controlling the carrier liquid concentration in each ink layer prior to the transfer from the imaging element 110 to the transfer element 130. This can be achieved by having a first layer on the transfer element 130 that has a high carrier liquid concentration and then having subsequent layers on the transfer element 130 with lower concentrations. In the example of FIG. 1, this is achieved by use of a compressive element 140. The compressive element 140 in some examples is a roller. The compressive element 140 is selectively engagable and is controlled by controller 150. The controller 150 can engage the compressive element 140 for each subsequent layer of liquid toner so as to remove a portion of carrier liquid from the subsequent layers. The controller 150 may also disengage the compressive element 140 for at least one first layer of liquid toner so as to retain carrier liquid in the first layer. In some examples, the controller 150 ensures that the compressive element 140 is disengaged for at least one first layer, and the action of disengagement may not be required if it is determined that the compressive element 140 is already disengaged. In some examples, the compressive element 140 is mechanically pressed onto the imaging element 110 before the inked image is transferred to the transfer member 130.

By retaining carrier liquid in at least one first layer and removing carrier liquid from subsequent layers, the over drying of the first layer may be reduced. Depending on the implementation, different separation layers may have different carrier liquid concentrations by selectively engaging the compressive element. In certain cases, the compressive element may be digitally controllable by the controller, i.e. have two or more states that may be selectively controlled for a given separation layer.

In certain cases, this may enable the temperature of transfer member 130 to be reduced because the subsequent layers contain a lower proportion of carrier liquid that would otherwise be present without the engagement of the compressive element 140. Additionally, external heating or air flow may also be reduced. By reducing the exposure of the multiple layers to heat sources, the first layer is less likely to be over dried, thus enhancing print quality.

Figure 2A:
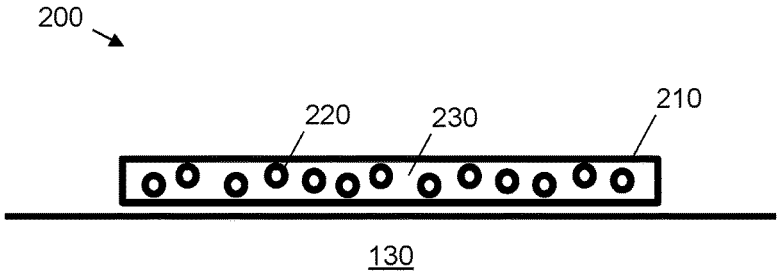
FIG. 2A is a schematic diagram showing a first layer of liquid toner applied to a heatable transfer element in accordance with an example.

FIG. 2A is a schematic diagram 200 showing a first layer of liquid toner 210 applied to a heatable transfer element, such as transfer element 130 in FIG. 1, in accordance with an example. In this example, the layer 210 comprises ink particles 220 and a carrier liquid 230 as previously described.

Figure 2B:
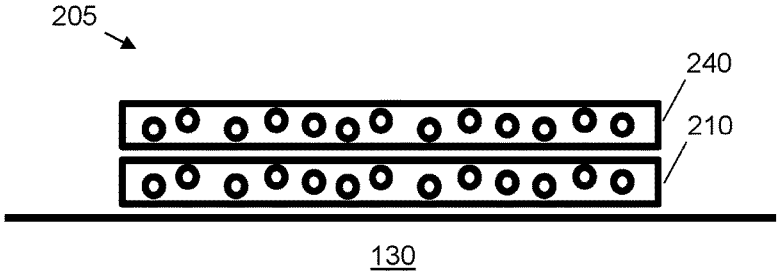
FIG. 2B is a schematic diagram showing a second layer of liquid toner applied on top of the first layer illustrated in FIG. 2A in accordance with an example.

FIG. 2B is a schematic diagram 205 showing a second layer of liquid toner 240 applied on top of the first layer 210 illustrated in FIG. 2A in accordance with an example. Similarly, the second layer of liquid toner may comprise ink particles 220 and carrier liquid 230. In some examples the ink particles and carrier liquid are in different concentrations in each layer. In other examples, the type of ink particles and carrier liquid may be different to the type of ink particles and carrier liquid in other layers. In some examples the constituent components of the liquid toner may be chosen specifically to control the evaporation characteristics of the liquid toner, for example to reduce or enhance evaporation of the carrier liquid. Therefore, in some example printers, the controller 150 may engage the compressive element 140 according to the characteristics of the liquid toner. Thus the portion of carrier liquid removed may be dependent on the characteristics of the liquid toner.

Figure 3A:
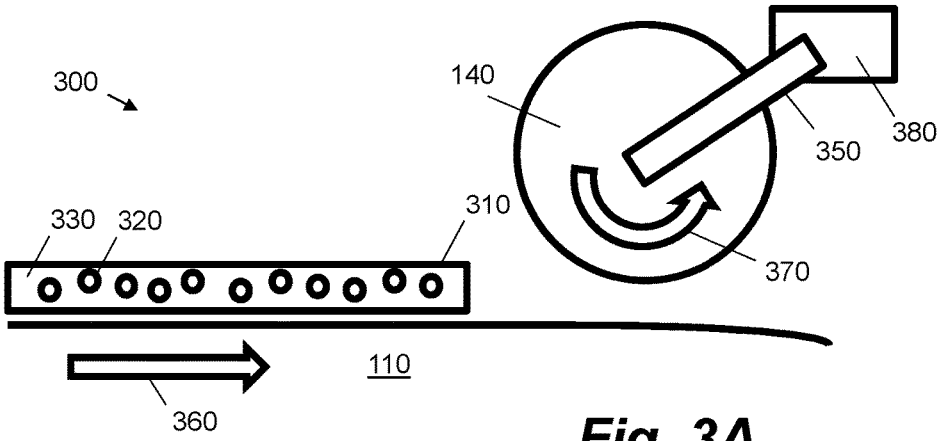
FIG. 3A is a schematic diagram showing a compressive element prior to engaging a layer of liquid toner on a photo imaging plate in accordance with an example.

FIG. 3A is a schematic diagram 300 showing a compressive element, such as compressive element 140 from FIG. 1, prior to engaging a layer of liquid toner 310 on an imaging element, such as imaging element 110, in accordance with an example. In some examples, the layer of liquid toner 310 is the second, or any subsequent layer following at least one first layer. In certain cases, there may be a plurality of layers where the compressive element 140 is disengaged prior to the arrival layer of liquid toner 310 as shown in FIG. 3A. The compressive element 140 may be a roller that rotates in the direction shown by arrow 370, and may be coupled to a roller mounting 350. A roller engagement mechanism 380 may also be coupled to the roller mounting 350 to selectively apply the roller to the imaging element 110.

Although the compressive element 140 is shown coupled to the roller mounting 350 and the roller engagement mechanism, one skilled in the art will appreciate that similar mechanisms can be used to allow selective engagement. For example, a standard image development unit engage mechanism can be used with the compressive element 140 to enable selective engagement. Such image development unit engage mechanisms are well known in the art.

In this example, the layer of liquid toner 310 comprises ink particles 320 and liquid carrier 330. In one example, the liquid toner may comprise 80% liquid carrier 330 and 20% ink particles 320 prior to engaging the compressive element 140. The layer of liquid toner 310 is formed on the surface of the imaging element 110 which is rotating in the direction indicated by the arrow 360, such that the layer 310 travels towards the compressive element 140.

In one example, controller 150 causes the roller engagement mechanism to apply the compressive element 140 to the imaging element 110, thus causing the compressive element 140 to engage the layer 310. Thus the engagement system is digitized. For example, the controller 150 may determine that the layer 310 is not the first layer 210, and is the second layer 240 or any other subsequent layer. Accordingly the controller 150 engages the compressive element 140 so as to remove a portion of carrier liquid 330 from the layer 310.

In some examples, the compressive element 140 is mechanically pressed onto the imaging plate 110 before transferring the ink to the transfer element 130. In certain cases, the compressive element 140 may have two or more states, wherein each state has a different nip length and/or nip distance, i.e. the length of imaging element wherein a roller has a distance less than a threshold and/or a set distance at a closest point between a roller and the imaging element 140.

Figure 3B:
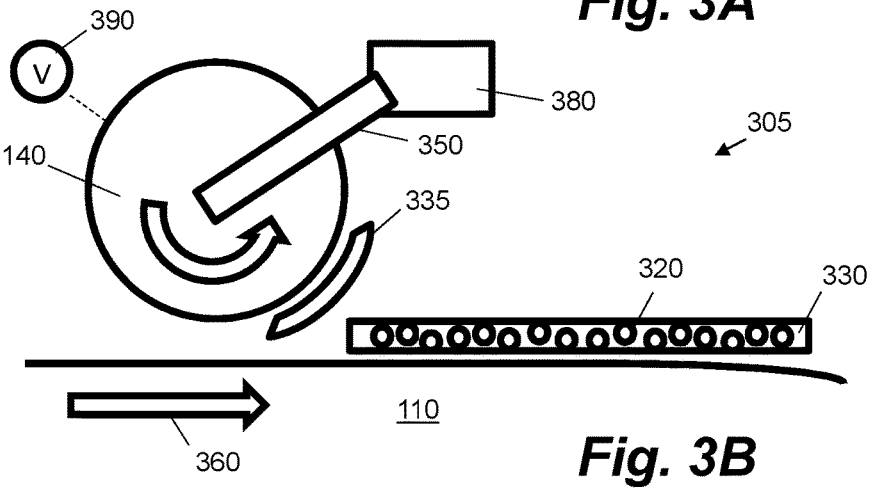
FIG. 3B is a schematic diagram showing a compressive element after engaging a layer of liquid toner on a photo imaging plate in accordance with an example.

FIG. 3B is a schematic diagram 305 showing a compressive element 140, after engaging a layer of liquid toner 310 on an imaging element 110 in accordance with an example. In this illustrated example, the layer 310 can be seen to contain a lower proportion of carrier liquid 330 than prior to engaging the compressive element 140. The engagement of the compressive element 140 causes a portion of carrier liquid 335 to be removed from the layer 310. The carrier liquid may be removed by the compressive element 140 using capillary forces.

In some examples, the difference in carrier liquid concentration between the layer 310 going through the compressive element 140 and a layer that does not engage the compressive element 140 is greater than 20%. For example 50% of carrier liquid may be removed by the compressive element 140.

In some examples, the compressive element 140 is selectively engageable by adjusting one or more of the roller force, the roller pressure, the roller velocity and the roller voltage. Adjusting these values can affect the amount of liquid carrier removed. Other factors that affect the efficiency of carrier liquid removal include the nip length, i.e. the surface area over which the compressive element 140 and the imaging element 110 are engaged. Nip length can be affected by the hardness of the rollers, and the force and pressure applied during the engagement. Other factors affecting efficiency include the relative velocity between the imaging element 110 and the compressive element 140, their diameters and the roller formulation. For example, the thickness of the rubber coating on the roller can affect the efficiency of carrier liquid removal, as well as the surface roughness. In some cases the roller is uncoated. In some examples the compressive element 140 is made from polyurethane. Some or all of these operational parameters may be adjusted so as to control the proportion of liquid carrier that is removed from the imaging element 110. The adjustment of these operational parameters may depend on the particular layer of liquid toner and/or the constituent components of the particular layer of liquid toner. For example, a greater proportion of carrier liquid may be removed from the outer layers as compared to the inner layers.

In some examples, a voltage 390 is applied to the compressive element 140 during engagement. By utilizing proper electrical voltage, the compressive element 140 may remove carrier liquid while at the same time compressing the ink particles onto the imaging element 110. Thus the compressive element 140 takes advantage of the electrical charge of the ink, whereby the ink carries with it the voltage of the image development unit 120. The measured ink voltage may be a function of coverage on the imaging element 110. It should be noted that the voltage applied to the compressive element 140 does not affect the uncharged carrier liquid.

In one example, the voltage applied to the compressive element 140 may be of the same polarity as the ink particles and the imaging element 110, and is different to a voltage of the ink particles in an inked image such that an electrostatic force is applied to retain the ink particles against the imaging element 110. Thus the ink is repelled by the compressive element 140 and compressed against the imaging element 110. The applied voltage may be controlled by the controller 150 and in some examples is chosen according to the particular liquid toner being used and/or the ink coverage. The voltage may be different to a voltage of the imaging element 110 such that an electrostatic force is applied to residue charges to transfer said charges to the compressive element 140. The residue charges may make up unwanted noise in the image and may be in a non-image area of the imaging element 110.

In one example, the ink particles are negatively charged, so the voltage applied to the compressive element 140 is negative. When the voltage applied to the compressive element is lower than the voltage of the ink particles in the inked image and is higher than the voltage of the imaging element 110, the ink is compressed against the imaging element 110 and the residue charges in the background are transferred to the compressive element 140. In another example the ink particles are positively charged and the voltage applied to the compressive element 140 is positive. When the voltage applied to the compressive element 140 is higher than the voltage of the ink particles in the inked image and is lower than the voltage of the imaging element 110, the ink is compressed against the imaging element 110 and the residue charges in the background are transferred to the compressive element 140. For example, when the ink particles are negatively charged, the compressive element 140 voltage may be −800V, the ink particle voltage may be −500V and the imaging element 110 voltage (which corresponds to the image background) is −900V. In such a scenario the ink particles are forced onto the imaging element 110, and any residual charges on the imaging element 110 are attracted to the compressive element 140. By applying voltages to the compressive element 140 and the imaging element 110, image quality can be enhanced. In another example, for negatively charged ink particles, the voltage applied to the compressive element is −700V and the ink particle voltage is −450V. This means that the ink particles are compressed against the imaging element 110 and the residue charges in the background are transferred to the compressive element 140.

Figure 3C:
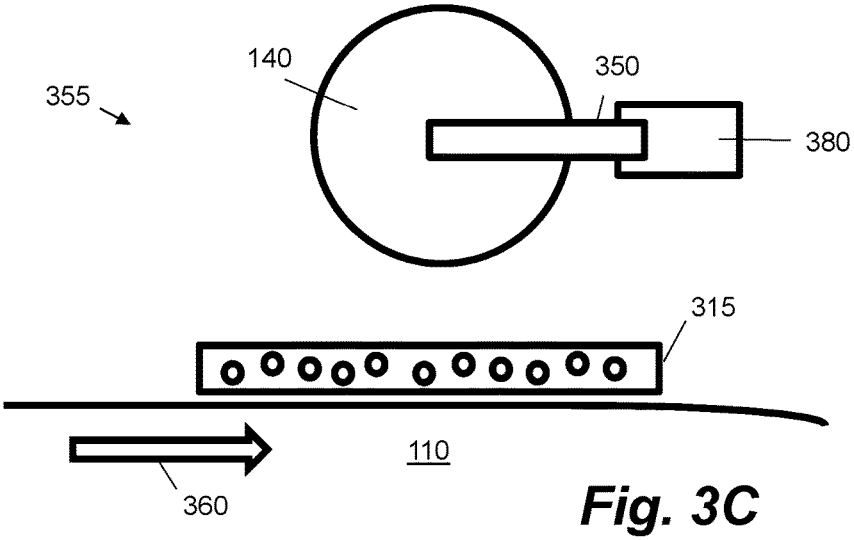
FIG. 3C is a schematic diagram showing a disengaged compressive element for a layer of liquid toner on a photo imaging plate in accordance with an example.

FIG. 3C is a schematic diagram 355 showing a disengaged compressive element 140 for a layer of liquid toner 315 on an imaging element 110 in accordance with an example. In this example, the layer 315 is the first layer 210. The controller 150 may determine that the layer 315 is the first layer 210 and disengage the compressive element 140 so as to retain carrier liquid in the first layer 315, 210. In some examples, the compressive element 140 may already be disengaged, such that controller 150 may not disengage compressive element 140. In certain cases, the compressive element 140 may be disengaged for a plurality of first layers, e.g. two or three color separations in a set of three or more separations. In certain cases, monochrome layers may also be used. In some examples, the compressive element 140 is in an disengaged position away from the imaging element 110 for a first layer 210 of liquid carrier applied to the imaging element 110, and the compressive element 140 is in an engaged position for a subsequent layer 240 of liquid carrier applied to the imaging element.

Figure 4:
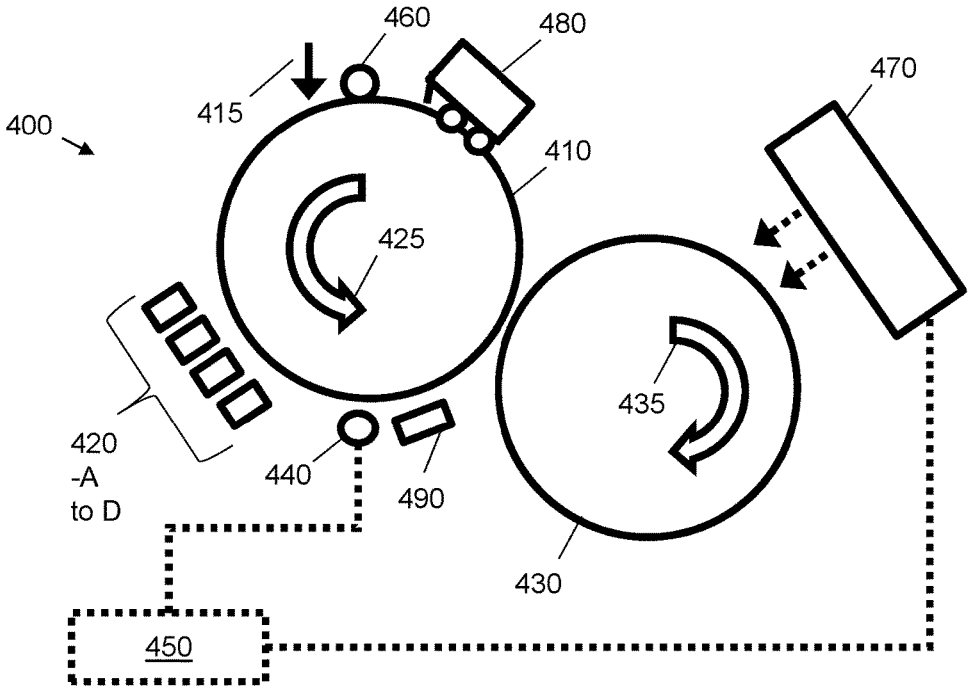
FIG. 4 is a schematic diagram showing a liquid electrophotographic printer comprising a variable air supply in accordance with an example.

FIG. 4 is a more detailed schematic diagram showing a liquid electrophotographic printer 400 comprising a variable air supply 470 in accordance with an example. An example system for adjusting the air supply applied to evaporate carrier liquid is described in U.S. Pat. No. 7,907,873 and is incorporated herein by reference.

Printer 400, in use, comprises a photo imaging plate 410, rotating in the direction indicated by arrow 425 and a heated blanket 430, rotating in the direction indicated by arrow 435. The printer 400 further comprises a photo charging unit 460 and one or more lasers 415 as discussed in accordance with printer 100 of FIG. 1. The printer 400 further comprises a plurality of image development units 420A-D, as well as a roller 440 in communication with controller 450. The controller 450 may also be in communication with the variable air supply 470. The printer may also comprise a cleaning station 480 and a pre-transfer erase unit 490.

The pre-transfer erase unit 490 comprises a set of diodes to illuminate the photo imaging plate 410. Illumination causes a homogeneous conductivity across the photo imaging plate 410 leading to dissipation of the charges still existing on the background. This enables a clean transfer of the image in the next stage avoiding the background charges from sparking to the heated blanket 430 and damaging the image and, in time, the photo imaging plate 410 and the heated blanket 430.

The cleaning station 480 is used to remove any residual ink on the photo imaging plate 410 after the second transfer has taken place. The cleaning station 480 may also cool the photo imaging plate 410 from heat transferred during contact with the hot blanket of the heated blanket 430. The photo imaging plate 410 is then ready to be recharged by the charging unit 460 ready for the next image.

The variable air supply unit 470 may be used to apply air to the layers acquired on the heated blanket 430. This air acts to dry the images as the multiple separations are acquired. Often, air from the variable air supply units 470 is applied during the entire printing process and sometimes null cycles are added to further dry the image. Null cycles are revolutions of the ITM 430 wherein no further layers are acquired, thus allowing the air supply to sufficiently dry the layer. The use of null cycles for subsequent layers further increases the time at least one first layer spends on the heated blanket 430, which can lead to over-drying. Thus by selectively controlling and adjusting the drying level of the variable air supply 470 for each layer, over-drying of the first layer can be reduced.

In one example, the controller 450 may control the variable air supply unit 470 to provide less air to a first printed separation layer as compared to a final printed separation. In some examples, the controller 450 may control the variable air supply 470 to provide less air flow to an image with a lower percentage coverage as compared to an image with a high percentage coverage. The controller 450 can thus control the drying level of the variable air supply unit 470 as a function of the order that the separations are developed on the heated blanket 430 and/or the percent coverage of each separation. The controller 450 may also control the drying level as a function of the intended print substrate on which the image is to be printed, and/or the operational parameters of the roller 440 discussed earlier.

In some examples, the variable air supply unit 470 may also include a heating system to control the temperature and humidity levels in the supplied air. This heating system can also be controlled by the controller 450.

In some examples, the controller 450 can instruct the variable air supply 470 to operate with a first set of air supply parameters for the first layer and with a second set of air supply parameters for a combination of the first and second layers. In one example, the first set of air supply parameters provide a slower drying rate than the second set of parameters. An example set of air supply parameters may mean that the variable air supply 470 supplies no air to the layer(s), or that the air is diverted away from the heated blanket 430. One or more air supply parameters may also control the heating system in the variable air supply unit 470. For example, the second set of air supply parameters may provide a higher temperature air flow as compared to the first set of air supply parameters.

In another example, the controller 450 can instruct the variable air supply 470 to supply air at a first speed for the first layer and to supply air at a second speed for a combination of the first and second layers. In one example, the second speed is higher than the first speed. The first speed may also be zero, such that substantially no air flows onto the first layer. Subsequent layers may also be subjected to air supplied at various air speeds. In some examples, subsequent layers experience higher air speeds than previous layers.

In some examples the roller 440 and the variable air supply unit 470 operate in tandem for better performance at reducing over-drying. The controller 450 may control the variable air supply unit 470 based on the engagement level of the roller 440. For example, the controller 450 may determine that removing carrier liquid is more efficient for a particular layer using the roller 440, and may accordingly reduce the drying and/or heating level of the variable air supply unit 470, or vice-versa. This determination may be dependent on the layer number, or the particular liquid toner being used.

Figure 5:
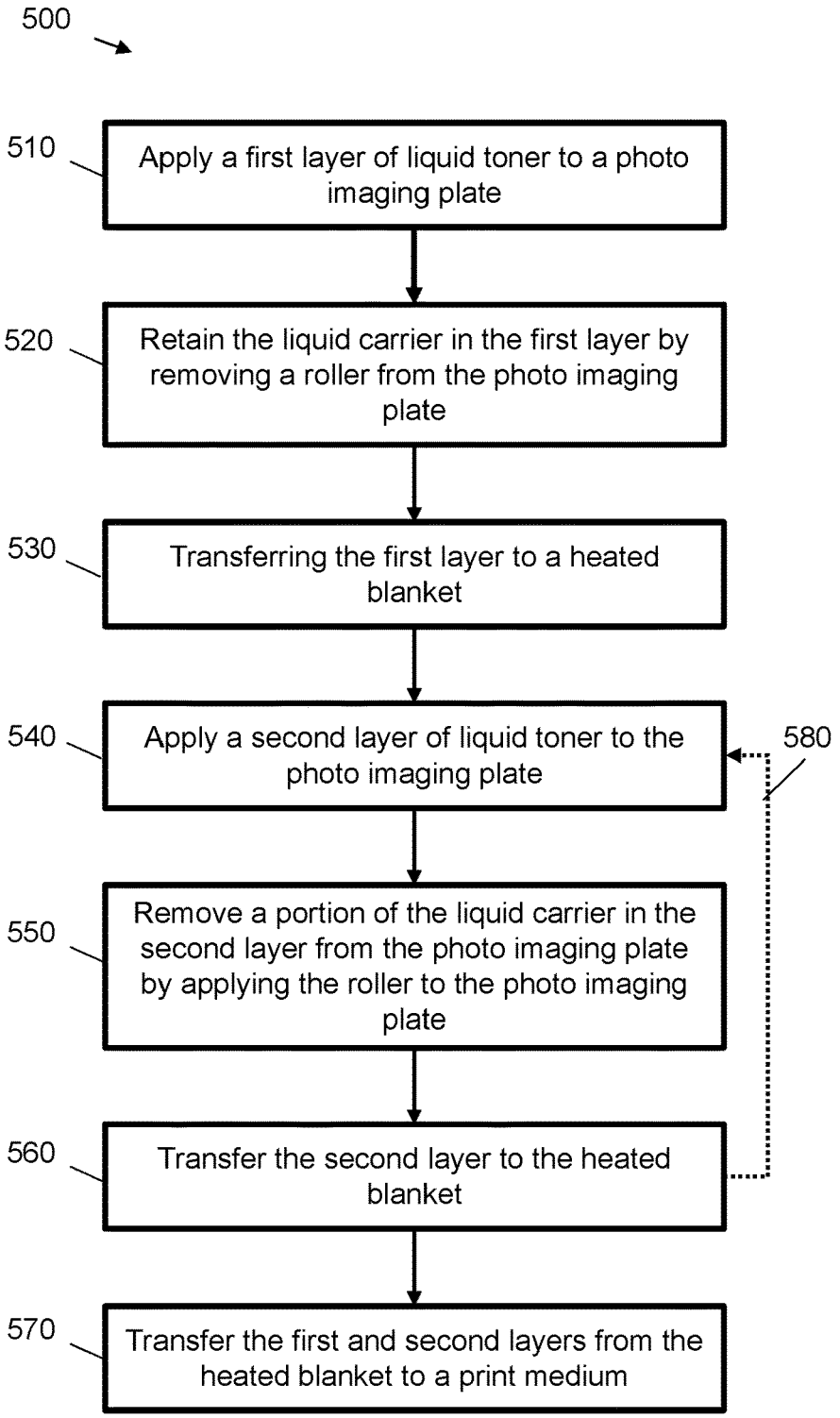
FIG. 5 is a flow diagram showing a method of printing an image in a liquid electrophotographic printer according to an example.

FIG. 5 is a flow diagram showing a method 500 of printing an image in a liquid electrophotographic printer according to an example. The method can be performed by the printer 100, 400 discussed in FIGS. 1 and 4. At block 510 a first layer of liquid toner is applied to an imaging element such as a photo imaging plate. This may be imaging element 110 or photo imaging plate 410. In this example, the liquid toner comprises charged pigment or ink particles and a liquid carrier. The ink may be applied by an ink development unit 120, 420A-D described above in relation to FIGS. 1 and 4, or by some other means. At block 520, the liquid carrier is retained in the first layer by removing a roller from the photo imaging plate. The roller may comprise compressive element 140 or roller 440. For example, the roller may be disengaged by a controller 150, 450 as described above with reference to FIGS. 1 and 4. At block 530, the first layer is transferred to a heated blanket, such as transfer element 130 or heated blanket 430. In some examples the heated blanket is formed on, or is part of an intermediate transfer member. At block 540, a second layer of liquid toner is applied to the photo imaging plate. The second layer of liquid toner may be a different color layer and/or separation to the first layer. At block 550, a portion of the liquid carrier in the second layer is removed from the photo imaging plate by applying the roller to the photo imaging plate. The application of the roller may be controlled by controller 150, 450. At block 560, the second layer is transferred to the heated blanket. In this example, the second layer is applied to the heated blanket on top of the first layer. At block 570, the first and second layers are transferred from the heated blanket to a print medium. Step 580 indicates that blocks 540, 550 and 560 may be repeated for further layers of liquid toner such that in step 570, the multiple layers are transferred to the print medium.

In some example methods, retaining the liquid carrier and removing a portion of the liquid carrier in blocks 520 and 550 respectively, comprise adjusting one or more operational parameters for the roller so as to control a proportion of liquid carrier that is removed from the photo imaging plate. For example, these operation parameters may include one or more of the roller force, the roller pressure, the roller velocity and the roller voltage.

In some example methods, an electrical bias can be applied to the roller so as to repel charged pigment particles from the roller and to attract residue charges from the photo imaging plate. This electrical bias can be controlled by applying and/or adjusting the roller voltage.

In some example methods, subsequent to transferring the first layer to the heated blanket, the method comprises applying a first air flow to the heated blanket, and subsequent to transferring the second layer to a heated blanket, the second layer being transferred onto the first layer on the heated blanket, the method comprises applying a second air flow to the heated blanket. For example, the second air flow results in a faster ink-layer drying rate than the first air flow. In some examples, the first air flow involves no air flowing onto the heated blanket. The air flow may be provided by a variable air supply 470 as described in FIG. 4.

In some example methods, before transferring the first and second layers from the heated blanket to the print medium, the method further comprises applying an additional layer of liquid toner to the photo imaging plate; removing a portion of the liquid carrier in the additional layer from the photo imaging plate by applying the roller to the photo imaging plate; and transferring the additional layer to the heated blanket. These additional steps are shown in FIG. 5, in loop 580 and can be repeated for any number of additional layers. In some examples, a proportion of liquid carrier removed with respect to the additional layer is greater than a proportion of liquid carrier removed with respect to the second layer, and each additional layer is transferred onto a previously transferred layer. In this example the method step of transferring the first and second layers from the heated blanket to a print medium shown in block 570 comprises transferring a combination of all transferred layers from the heated blanket to the print medium.

As discussed, the method operations of applying, removing and transferring are repeated for one or more additional layers, where each layer may represent a different color separation.

Certain system components and methods described herein may be implemented by way of non-transitory computer program code that is storable on a non-transitory storage medium. In some examples, the controller 150, 450 may comprise a non-transitory computer readable storage medium comprising a set of computer-readable instructions stored thereon. The controller 150, 450 may further comprise a processor. The computer-readable instructions may, when executed by the processor, cause the processor to disengage the compressive element 140, 440 for a first layer of liquid toner developed on the imaging element 110, 410 so as to retain carrier liquid in said first layer, and engage the compressive element 140, 440 for a subsequent layer of liquid toner developed on the imaging element 110, 410 so as to remove a portion of carrier liquid from said subsequent layer.

What is claimed is:

1. A liquid electrophotographic printer comprising:

an imaging element;

at least one image development unit to develop a latent image by depositing a layer of liquid toner comprising ink particles and a carrier liquid onto the imaging element, to form an inked image;

a heatable transfer element to receive the inked image from the imaging element and to transfer the inked image to a print substrate;

a compressive element to remove a portion of carrier liquid from the inked image on the imaging element prior to transfer to the heatable transfer element, the compressive element being selectively engageable; and a controller to disengage the compressive element for a first layer of liquid toner so as to retain carrier liquid in said first layer and to engage the compressive element for a subsequent layer of liquid toner so as to remove a portion of carrier liquid from said subsequent layer.

2. The liquid electrophotographic printer of claim 1, wherein:

a voltage is applied to the compressive element during engagement, said voltage is of a same polarity as the ink particles and the imaging element, said voltage is different from a voltage of the ink particles in an inked image such that an electrostatic force is applied to retain the ink particles against the imaging element, and said voltage is different from a voltage of the imaging element such that an electrostatic force is applied to residue charges to transfer said charges to the compressive element.

3. The liquid electrophotographic printer of claim 2, wherein:

if the ink particles are negatively charged, the voltage applied to the compressive element is lower than the voltage of the ink particles in the inked image and higher than the voltage of the imaging element; and if the ink particles are positively charged, the voltage applied to the compressive element is higher than the voltage of the ink particles in the inked image and lower than the voltage of the imaging element.

4. The liquid electrophotographic printer of claim 1, comprising:

a variable air supply for drying layers of the inked image present on the heatable transfer element, wherein the controller instructs the variable air supply to operate with a first set of air supply parameters for the first layer and with a second set of air supply parameters for a combination of the first and second layers, and wherein the first set of air supply parameters provide a slower drying rate than the second set of air supply parameters.

5. The liquid electrophotographic printer of claim 4, wherein the controller instructs the variable air supply to supply air at a first speed for the first layer and to supply air at a second speed for a combination of the first and second layers, and wherein the second speed is higher than the first speed.

6. The liquid electrophotographic printer of claim 1, wherein the compressive element comprises a roller and the controller engages the roller against the imaging element.

7. The liquid electrophotographic printer of claim 6, wherein the compressive element is selectively engageable by adjusting one or more of:

a roller force;

a roller pressure;

a roller velocity; and a roller voltage.

8. A method of printing an image in a liquid electrophotographic printer, comprising:

applying a first layer of liquid toner to a photo imaging plate, the liquid toner comprising charged pigment particles and a liquid carrier;

retaining the liquid carrier in the first layer by removing a roller from the photo imaging plate;

transferring the first layer to a heated blanket;

applying a second layer of liquid toner to the photo imaging plate;

removing a portion of the liquid carrier in the second layer from the photo imaging plate by applying the roller to the photo imaging plate;

transferring the second layer to the heated blanket; and transferring the first and second layers from the heated blanket to a print medium.

9. The method of claim 8, wherein retaining the liquid carrier and removing a portion of the liquid carrier comprise:

adjusting one or more operational parameters for the roller so as to control a proportion of liquid carrier that is removed from the photo imaging plate.

10. The method of claim 8, wherein removing a portion of the liquid carrier comprises:

applying an electrical bias to the roller so as to repel charged pigment particles from the roller and to attract residue charges from the photo imaging plate.

11. The method of claim 8, wherein:

subsequent to transferring the first layer to the heated blanket, the method comprises applying a first air flow to the heated blanket, and subsequent to transferring the second layer to the heated blanket, the second layer being transferred onto the first layer on the heated blanket, the method comprises applying a second air flow to the heated blanket, wherein the second air flow results in a faster ink-layer drying rate than the first air flow.

12. The method of claim 8, comprising, before transferring the first and second layers from the heated blanket to the print medium:

applying an additional layer of liquid toner to the photo imaging plate;

removing a portion of the liquid carrier in the additional layer from the photo imaging plate by applying the roller to the photo imaging plate; and transferring the additional layer to the heated blanket, wherein a proportion of liquid carrier removed with respect to the additional layer is greater than a proportion of liquid carrier removed with respect to the second layer, wherein each additional layer is transferred onto a previously transferred layer, and wherein transferring the first and second layers from the heated blanket to a print medium comprises transferring a combination of all transferred layers from the heated blanket to the print medium.

13. The method of claim 12, wherein applying, removing and transferring operations are repeated for one or more additional layers, each layer representing a different color separation.

14. Apparatus for modifying a proportion of liquid carrier applied to an imaging element in a liquid electrophotographic printer comprising:

a roller;

a roller mounting; and a roller engagement mechanism coupled to the roller mounting to selectively apply the roller to the imaging element, wherein in an engaged position, the roller removes a portion of imaging oil from the imaging element, wherein in a disengaged position away from the imaging element the roller does not remove imaging oil from the imaging element, wherein the roller is in the disengaged position away from the imaging element for a first layer of liquid carrier applied to the imaging element, and wherein the roller is in the engaged position for a subsequent layer of liquid carrier applied to the imaging element.

15. The apparatus of claim 14, wherein:

a voltage is applied to the roller during engagement, the voltage is of a same polarity as ink particles in the liquid carrier and the imaging element, the voltage is different from a voltage of the ink particles such that an electrostatic force is applied to retain the ink particles against the imaging element, and the voltage is different from a voltage of the imaging element such that an electrostatic force is applied to residue charges to transfer the charges to the roller.

16. The apparatus of claim 15, wherein:

if the ink particles are negatively charged, the voltage applied to the roller is lower than the voltage of the ink particles and higher than the voltage of the imaging element; and if the ink particles are positively charged, the voltage applied to the roller is higher than the voltage of the ink particles and lower than the voltage of the imaging element.

* * * * *